US005105991A

United States Patent [19]

Johnson

[11] Patent Number: 5,105,991

[45] Date of Patent: Apr. 21, 1992

[54] BULK GOODS DISPENSER

[76] Inventor: Mats O. Johnson, 7 Castle Ct., Greenwich, Conn. 06830

[21] Appl. No.: 549,405

[22] Filed: Jul. 5, 1990

[51] Int. Cl.[5] ..... B67D 5/06

[52] U.S. Cl. ..... 222/185; 222/156; 222/181

[58] Field of Search ..... 222/158, 181, 185, 404, 222/424.5, 531, 564, 156; 211/90; 248/235

[56] References Cited

U.S. PATENT DOCUMENTS

| | | | |
|---|---|---|---|
| 1,755,490 | 4/1930 | Seymour | 222/185 |
| 2,582,207 | 1/1952 | Shaw | 222/185 |
| 2,754,998 | 7/1956 | Doepke et al. | 222/185 |
| 2,781,955 | 2/1957 | Kidd | 222/561 |
| 3,101,870 | 8/1963 | Betner | 222/541 |
| 3,998,362 | 12/1976 | Lapierre et al. | 222/185 |
| 4,211,343 | 7/1989 | Hughes et al. | 222/564 |
| 4,718,578 | 1/1988 | Radek et al. | 222/185 |
| 4,802,609 | 2/1989 | Morse et al. | 222/158 |
| 4,856,681 | 8/1989 | Murray | 222/158 |
| 4,889,263 | 12/1989 | Ellis et al. | 222/185 |

FOREIGN PATENT DOCUMENTS

| | | | |
|---|---|---|---|
| 2219279 | 12/1989 | United Kingdom | 222/424.5 |

*Primary Examiner*—Michael S. Huppert
*Assistant Examiner*—Kenneth Bomberg
*Attorney, Agent, or Firm*—Grimes & Battersby

[57] ABSTRACT

A dispensing apparatus comprising a product bin for storing the food product, and a regulator for controlling the flow of the food product. Extending through an aperture in the front of the apparatus is a raking member, by which the product may be manipulated along an inclined front panel into a dispensing unit. The product may then be dispensed by operation of a hinged and weighted front door, which forms a dispensing spout when opened. The dispensing apparatus may further comprise a funnel assembly which acts in concert with the regulator panel to control the speed of the food product entering into the product bin.

17 Claims, 7 Drawing Sheets

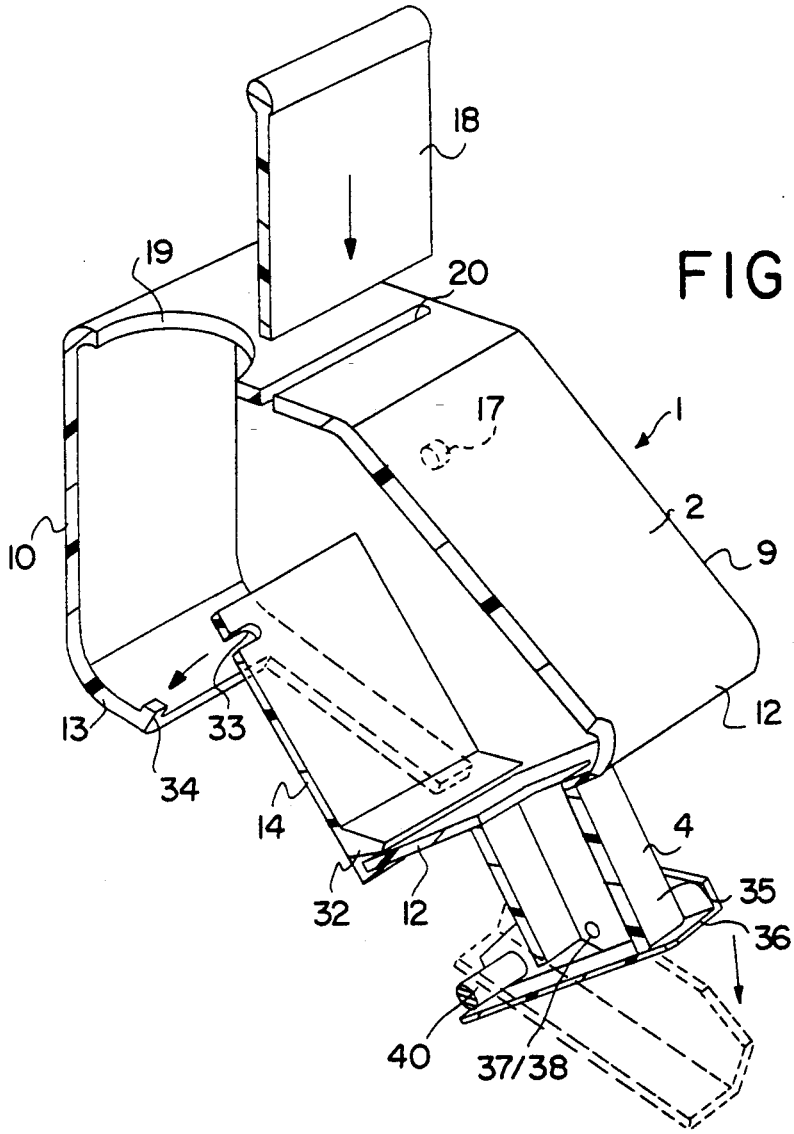
FIG. 6
FIG. 7
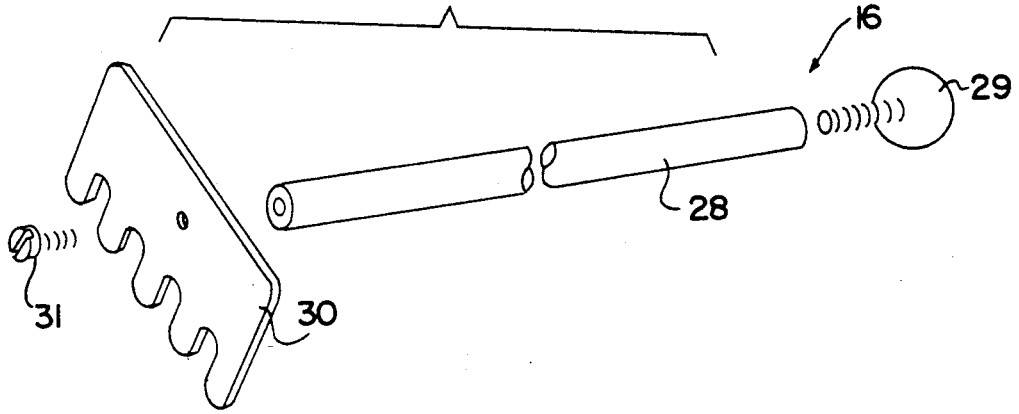

BULK GOODS DISPENSER

BACKGROUND OF THE INVENTION

1. Field of the Invention

This invention relates generally to a dispensing device and, more particularly, to a dispensing device for storing and dispensing bulk food products such as confectioneries.

It is a growing trend for supermarkets and specialty stores to feature bulk foods in which the customer is permitted to select and package a desired quantity of goods. Thus, the customer is permitted to selectively purchase goods so that the customer receives the feeling that he has purchased the best or freshest possible goods. A further advantage is that the customer is liberated from the weight and freshness limitations of packaged food products. A still further advantage is that by allowing the customer to serve himself, there is no need for an employee to package and stack such packaged goods so that the store limits its overhead costs, which savings may be passed on to customers.

Typically, bulk foods are stored in containers such as barrels or bins. Access is often gained to the product by means of a hinged door. The customer utilizes a scoop or cup to transfer the desired quantity from the barrel to a purchasing medium or receptacle, such as a plastic bag. However, such an arrangement does not prevent contamination of the foods. The very act of opening the hinged door exposes the remaining contents of the barrel to contamination by dust and other airborne particles. It is also impossible to keep the scoop free from food residue or customer mishandling since this arrangement allows the customer to have direct physical contact with the entire quantity of bulk product throughout the selection process. Further, a customer is not prevented from returning dispensed food or product to the bin in such an arrangement, thereby enhancing the possibility of product contamination.

An additional consideration in the storage and dispensing of bulk food products is the option of maintaining a continual flow of fresh product. In the method of dispensing bulk foods, as described above, it is difficult, if not impossible, to place fresh product beneath existing product. Therefore, stale product may easily become commingled with the fresher food product.

2. Description of the Prior Art

U.S. Pat. No. 4,211,343 to Hughes, et al is directed to a bulk dry food product storage, display and dispensing apparatus which includes a plurality of modules with each module having a plurality of hoppers. Each hopper comprises a continuously changing radius of curvature with the front portion being different than the rear portion so that older product moves forward towards the customer as new product is added in the apparatus. The apparatus also includes a rake to permit the customer to manipulate the product from any angle to a dispensing chute.

U.S. Pat. No. 4,802,609 to Morse, et al. is directed to a sanitary foodstuff dispenser in which bulk product is dispensed from a main storage hopper into a smaller intermediate dispensing bin to allow a customer to accurately measure the desired quantity of product. The customer then manipulates a lever in order to dispense the product.

U.S. Pat. No. 4,718,578 to Radek, et al. is directed to bulk goods dispenser, which like the Morse patent, permits the bulk product to be dispensed from a main storage hopper into a closed dispensing chamber. The customer then manipulates a lever to dispense the selected product into a receptacle.

U.S. Pat. Nos. 4,592,494 and 4,650,898 to Ellis, et al. are directed to sealed barrier containers in which bulk product is stored in a main storage container and dispensed into a second storage area through a valve mechanism. Once in the second storage area, the product may be maneuvered to the dispensing chute by the customer by a variety of dispensing mechanisms include a rake.

While these patents provide dispensing mechanisms which work to prevent contamination by the customer and from airborne particles, these patents provide complicated structures and do not provide the regulator means and funnel means of the present invention. Further, these patents fail to provide the removable bottom and raking means which enables the present invention to be readily cleaned.

SUMMARY OF THE INVENTION

It is an object of the present invention to provide a bulk foods dispenser which provides the customer with an unobstructed, continuous view of the bulk product and the portion of same selected by the customer.

It is another object of the present invention to provide such a dispenser with mean for regulating the flow of bulk food.

It is yet another object of the present invention to provide such a dispenser which selectively permits the commingling of old bulk food with new bulk food or the placement of new bulk food after old bulk food.

It is still another object of the present invention to provide such a dispenser with means for easily locking the dispenser into position to render it stable and also permit a series of dispensers to be aligned horizontally.

It is yet still another object of the present invention to provide such a dispenser which minimizes the time spent by the seller in restocking the dispenser.

It is still yet another object of the present invention to provide such a dispenser with raking means which permits the customer to personally select the desired quantity of food product while providing the customer with continuous visual contact, yet maintain the integrity of the product bin and minimize the possibility for contamination of the product by the customer.

It is yet still another object of the present invention to provide such a dispenser which has a readily removable bottom means which facilitates cleaning of the device and can also act to facilitate the dispensing of the bulk foods.

These and other objects of the present invention are provided by a dispenser for dispensing particulate goods, which comprises means for receiving and storing the particulate goods. Said means has a top portion with an opening for receiving bulk goods and a slot therethrough, a front wall, and a bottom wall which angles downward towards said front wall. The dispenser further comprises a dispensing unit, which is positioned in said front wall, and has a housing and a movable door adapted to be attached to said housing. Said door forms a spout for dispensing the particulate goods when pivotally engaged in a downward plane. The dispenser still further comprises raking means adapted to be secured into position through said front wall, and adapted to manipulate the particulate goods from said bin into said dispensing unit, and regulator means positioned through the slot to regulate the amount of the particulate goods into and through portions of said bin.

BRIEF DESCRIPTION OF THE DRAWINGS

The above and other objects, features and advantages of the present invention will become apparent from the following detailed description of the accompanying drawings in which:

FIG. 6 is a cross-sectional view of the device of FIG. 1 without the funnel assembly and the display and storage tube;

FIG. 7 is an exploded view of the raking means of the device of FIG. 1;

DETAILED DESCRIPTION OF THE INVENTION

Figure 1:
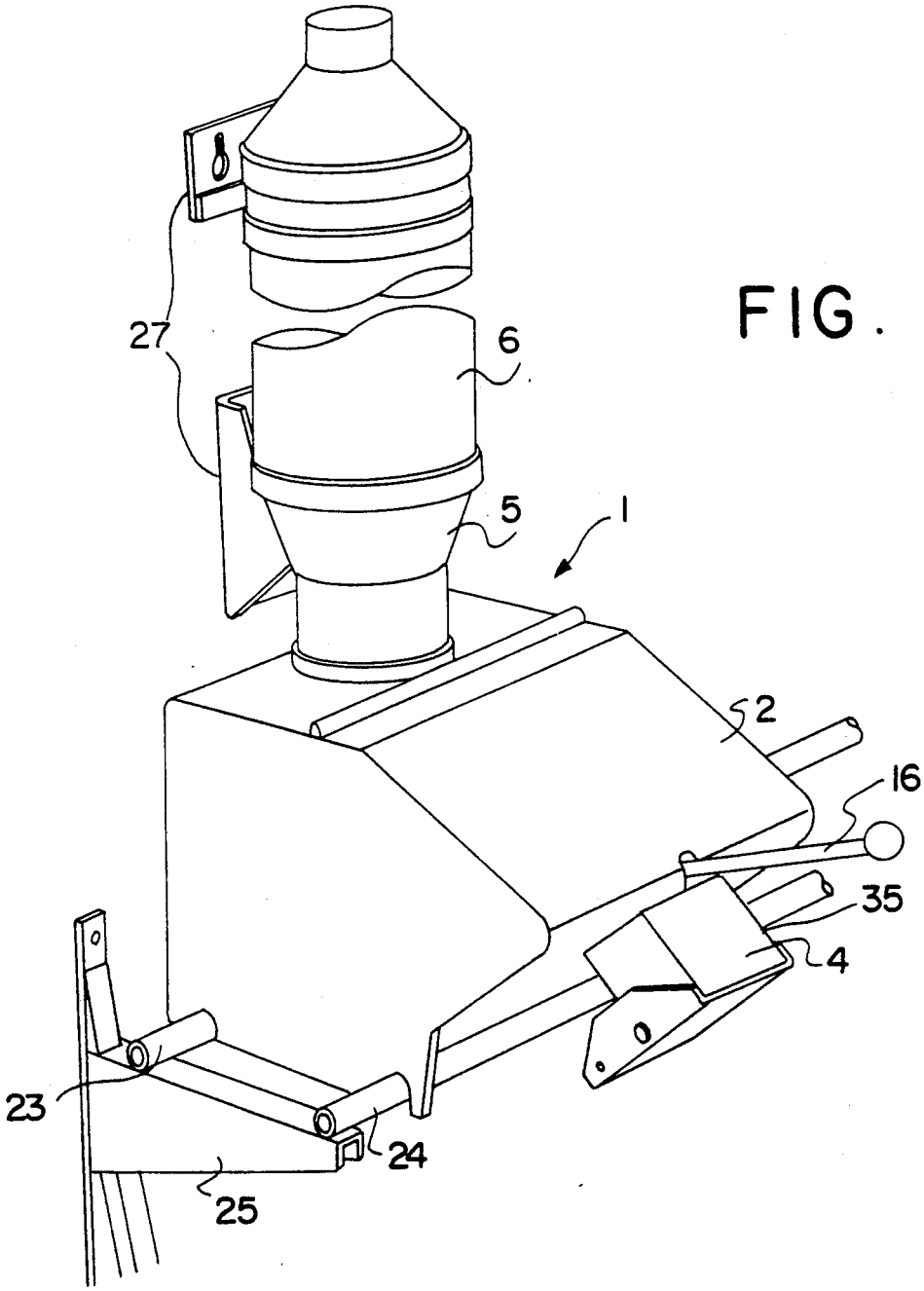
FIG. 1 is a perspective view of an embodiment of the device of the present invention mounted on wall brackets.

Referring to the figures and, in particular, FIG. 1, the bulk food product storage and dispensing device of the present invention is generally represented by reference numeral 1. The device 1 includes a product bin 2 having a dispensing unit 4 and raking means 16 adapted to be secured to the bin. The device also comprises a funnel or funnel assembly 5 adapted to connect to the product bin, and a display and storage tube 6 adapted to connect to the funnel.

Figure 2:
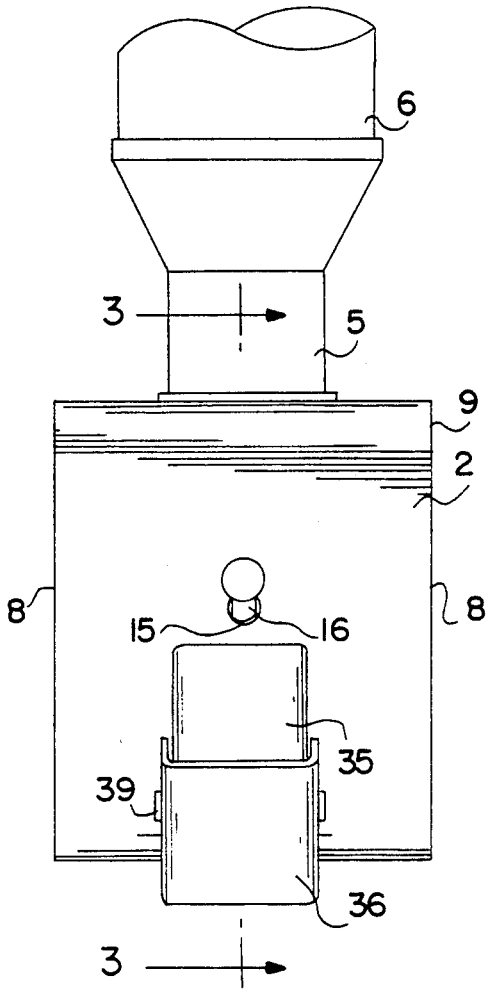
FIG. 2 is a front view of the device of FIG. 1.
Figure 3:
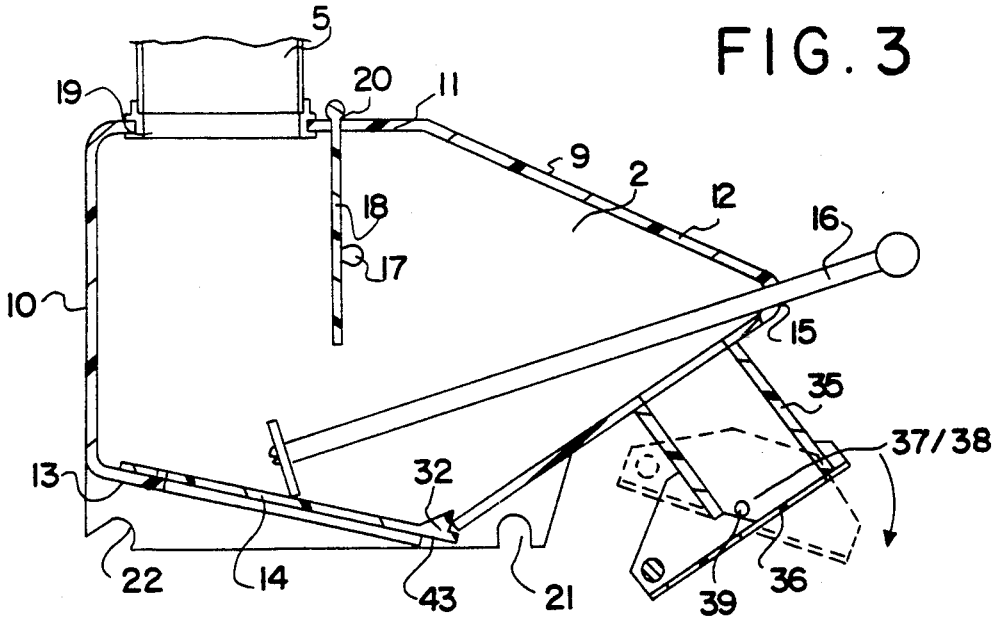
FIG. 3 is a cross-sectional view of the device taken along lines 3—3 of FIG. 2.

Referring to FIGS. 2 and 3, the product bin 2 is composed of a pair of side walls 8 and a framework 9. In the preferred embodiment, the framework 9 comprises a single piece of clear, top-quality acrylic plastic material, such as plexiglass, molded to form a back wall 10 which is positioned vertically, an inverted v-shaped front wall 12, a bottom wall 13 and a top wall 11.

The front wall 12 includes an aperture 15, which is adapted to receive raking means 16. The aperture 15 is preferably located in the fulcrum of the front wall 12. The bottom wall 13 is configured to have an opening therethrough to permit one to place one's hand through the opening. In a preferred embodiment, the opening is approximately 6½ inches in dimension.

The top wall 11 contains a slot 20 for receipt of the regulator or regulating means 18, and a circular opening 19 which is designed to receive the funnel assembly 5. The slot 20, which spans the width of the top wall, and is adapted to receive the regulator means or panel 18, must be slightly wider than the ¼ inch thickness of the panel. The circular opening 19 is adapted to receive the funnel or funnel assembly 5 which is held in position by an o-shaped ring 26.

Figure 5:
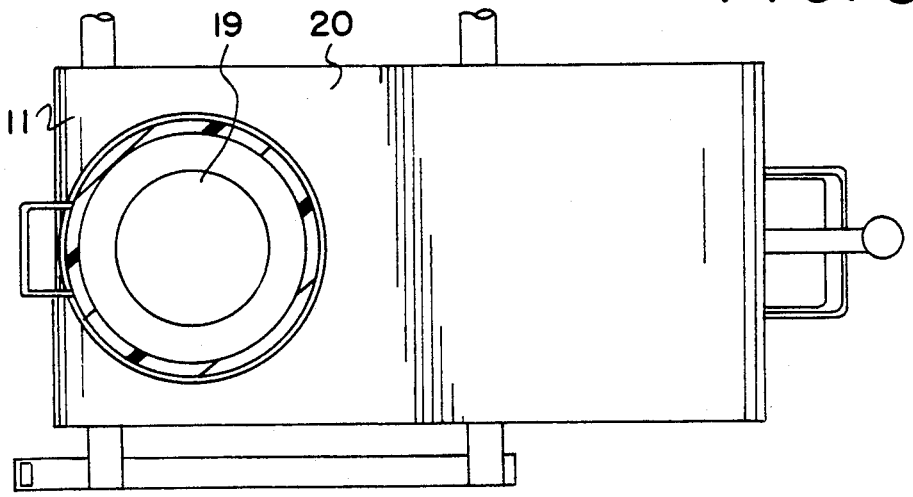
FIG. 5 is a top sectional view of the device of FIG. 1.

Referring to FIG. 5, the circular opening 19 of the top wall 11 is between 2 to 6 inches in diameter. In the preferred embodiment, the circular opening 19 is 4 inches in diameter.

The framework 9 is designed to provide a space 43 approximately ¾ inch wide between the front edge of the bottom wall 13 and the lower edge of front wall 12. This space 43 permits the insertion, manipulation, and removal of a bottom plate 14 which, preferably, is separate from the framework 9.

As shown in FIGS. 3 and 6, the bottom plate 14, is positioned on bottom wall 13 in the product bin 2, and is adapted to be moved and removed to permit ready access to the interior of the product bin to allow for the easy emptying, and therefore cleaning, of the device 1. This feature is particularly helpful since the storage and dispensing of food products, such as confectioneries, generates particle residue that needs repeated cleaning.

The bottom plate 14, when placed in positioned on the bottom wall 13, is angled toward the front wall 12 to facilitate flow of product towards the front wall and the dispensing unit 4 of the device 1. When the edge of the bottom plate 14 adjacent the back wall 10 moves upward, the bottom plate acts to urge the bulk products towards the front wall 12.

The bottom plate 14 comprises a square sheet of plexiglass or similar transparent plastic material, each side measuring approximately 8¼ inches in length. A triangular strip 32 of transparent plastic is bonded lengthwise along the span of the plate 14 to provide a lip approximately ¾ inch wide at the front edge. This arrangement allows the plate 14 to be inserted through the space 43 between the lower edge of the front wall 12 and the bottom wall 13. Once inserted, the bottom plate 14 will cover the space 43, while the rear edge of triangular strip 32 rests against the lower edge of the front wall 12 to effectively form a seal. In the embodiment of the invention depicted in the drawings, the bottom plate 14 may be provided with a small rectangular slot 33 designed to accommodate a pin 34, similarly bonded to the rear section of the bottom plate to provide further stability to the bottom plate while also maintaining the seal.

The contour of the triangular strip 32 permits the merchant to empty the product bin 2 by applying pressure in an upward direction through the opening in the bottom wall 13 onto the bottom of plate 14. The product may then be collected in a receptacle as it pours out of the opening in the bottom of the product bin 2 created by raising the bottom plate 14. While the bottom plate 14 is in a raised position, it may be easily removed by manipulating the triangular strip 32 below the lower edge of front wall 12, which in turn allows the bottom plate to slide completely out of the device 1. Once emptied, the bin 2 and the bottom plate 14 may be easily cleaned of the product residue generated by many bulk food products such as confectioneries.

Referring to FIGS. 3 and 6, each side wall of the framework 9 has a round hub 17 which is approximately ½ inch in diameter and extends inwardly approximately ¼ inch. The hubs 17, preferably, are aligned to provide a stop guide for the regulator panel 18. Specifically, the hubs 17 act to prevent the regulator panel 18 from moving out of the vertical plane toward the front wall 12 of the device 1. Panel 18 spans the length of the device 1 to prevent food products from filtering between the panel and the side walls 8 of the framework 9. Panel 18 is, preferably, approximately ¼ inches thick and can be of any vertical extent. As shown in FIG. 3, there should be, however, sufficient space between the lower edge of the regulator panel 18 and the bottom plate 14 to provide for some bulk products to pass through that space.

In a preferred embodiment, the side walls 8 of the bin 2 are secured together to form the framework 9 by cement or other bonding means. The framework 9, and therefore all of the walls, preferably, are made of a top-quality, transparent, acrylic material. In the most preferred embodiment, the material used is plexiglass. Plexiglass is preferred to ensure maximum visibility of the bulk food product.

Figure 4:
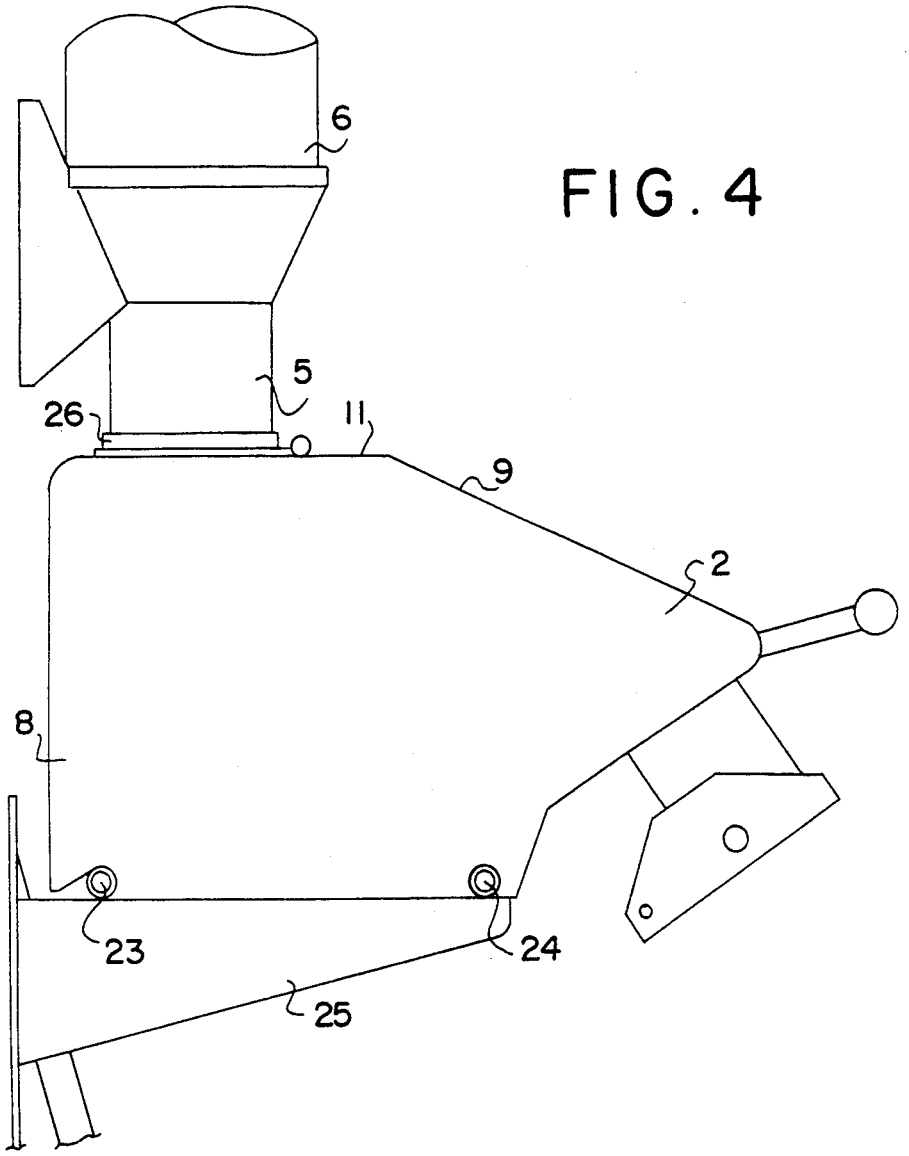
FIG. 4 is a side view of the device of FIG. 1.

Referring again to FIGS. 2 and 3, each side wall 8 is provided with a front slot 21 and a rear slot 22. The front slot 21 extends upwardly from the bottom plane of the side wall 8 at an approximately right angle, and is approximately 3 inches deep. The rear slot 22 is arranged at an approximately 45 degree angle from the bottom plane of side wall 8. Both front slot 21 and rear slot 22 are adapted to engage a pair of parallel horizontal bars 23 and 24 of a wall mount unit 25 which is shown in FIGS. 1 and 4. Unit 25 is itself mounted directly to a wall. To mount the device 1 onto the unit 25, the bin 2 is angled downward at a 45-degree angle to first engage the rear slot 22 with rear bar 23, and then angled straight down to engage the front slot 21 with the front bar 24 to secure the device 1 to the unit.

As shown in FIG. 1, unit 25 may be designed to permit the parallel horizontal bars 23 and 24 to extend horizontally along a wall for any desired length to allow the retailer to arrange a plurality of bins in series along the wall. Further, unit 25 may also be adapted to accommodate two rows of parallel horizontal bars, as shown in FIG. 1.

Figure 10:
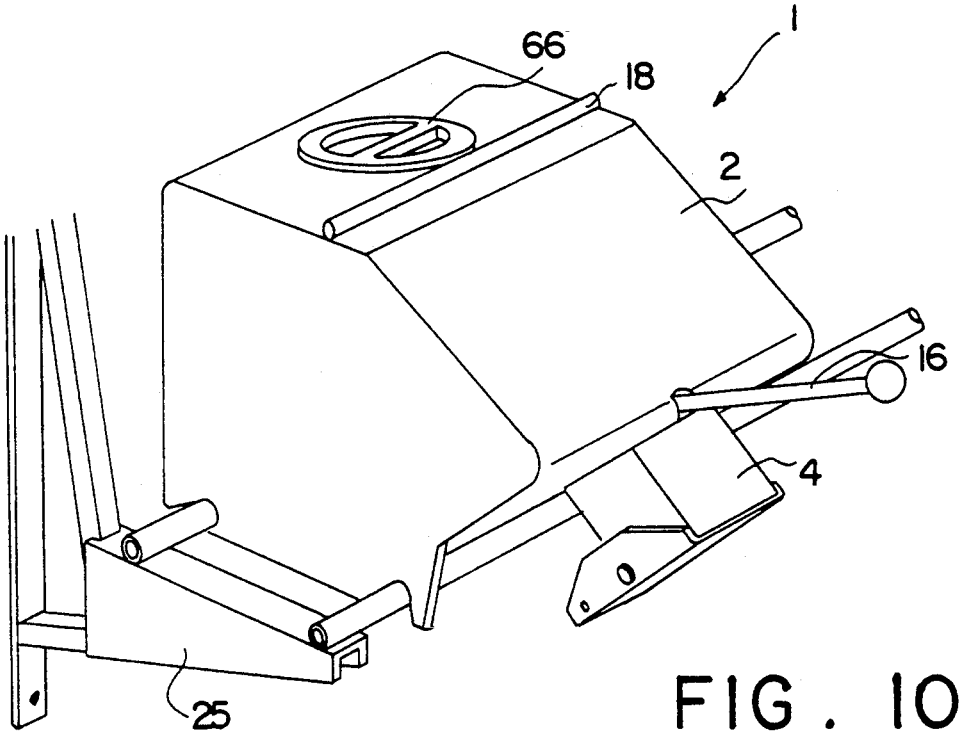
FIG. 10 is a perspective view of an alternative embodiment of the product bin of the device of FIG. 1 also mounted on wall brackets.

It should be noted that due to spacial limitations, only the top row of bins may be equipped with the connecting display and storage tube 6 and funnel 5, which is the preferred embodiment of the present invention. As a practical matter, the retailer would naturally wish to arrange his stock with the fastest-selling product in the top row of bins so that a continuous supply of fresh product is provided by the display and storage tube 6. To maintain the product in a contamination-free environment, product bin 2, as shown in FIG. 10, is adapted to receive a removable cap 66 designed to fit over circular opening 19 in lieu of the connecting funnel 5 and display and storage tube 6 of the embodiment of FIG. 1. The cap 66 thus provides a seal for the bin 2.

Referring to FIG. 6, the regulator panel 18 is used to regulate the speed with which the product enters bin 2, and therefore the amount of product that enters the bin, as well as the placement of the product in the bin 2. Significantly, the feature of the regulator panel 18 also permits the device 1 to accommodate a variety of different types of bulk food products.

The regulator panel 18 can be moved vertically or removed entirely to determine how much product should enter the front portion of the bin 2. Once the regulator panel 18 is inserted through the panel slot 20, it is maintained in a position substantially perpendicular to the top wall 11 by hubs 17. Since the back wall 10 of the device is vertical and the panel 18 is positioned vertically, product entering the bin 2 through opening 19 flows by gravity downward and the forward movement of the product is metered by the panel 18. The operator of the device 1 may, therefore, increase the amount of bulk food product available for dispensing, as well as increasing the speed of the product entering the bin 2, by grasping the lip and raising the regulator panel 18 in a upward direction. Further, the regulating panel 18 can be used to regulate the size of the product flowing into and towards the front wall 12 of the product bin 2. Specifically, when the regulator panel 18 is raised vertically larger sized product, as well as more product, is permitted to flow from the back wall 10 towards the front wall 12. As shown in FIG. 3, the regulator panel 18 is retained in the panel slot 20 in the top wall 11. Accordingly, the regulator panel 18 can be positioned at different heights in the panel slot 20.

The regulator panel 18, in a preferred embodiment, is made from the same clear, top-quality, acrylic plastic material, such as plexiglass, as device 1 in order to maintain maximum product visibility. The panel 18 is, preferably, rectangular in shape, and has a lip at one end which is a width greater than that of the regulating panel slot 20. The lip prevents the panel from sliding completely into the interior of the bin 2, and provides a means for easy manipulation and control of panel 18.

The vertical display and storage tube 6 is designed to accommodate the fastest-selling bulk food products, thereby ensuring a continuous supply of food product in the product bin 2 at all times. In the preferred embodiment, the tube 6 has a diameter approximately equal to the diameter of the top end of funnel assembly 5, thereby permitting easy insertion and removal of the tube. The gradual decrease of the diameter of the inverted conical portion of the funnel assembly 5 acts in concert with the regulator panel 18 to prevent the entire contents of the display and storage tube 6 from spilling into the product bin 2 by force of gravity. Further, the gradual decrease of the funnel assembly 5 acts to control the force of the bulk products moving into the bin 2. Thus, the funnel assembly 5 in concert with the regulator panel 18 control the speed, and therefore the amount, of food particles entering into bin 2.

In a preferred embodiment, the funnel 5 is made from a lightweight metal such as aluminum.

Figure 11:
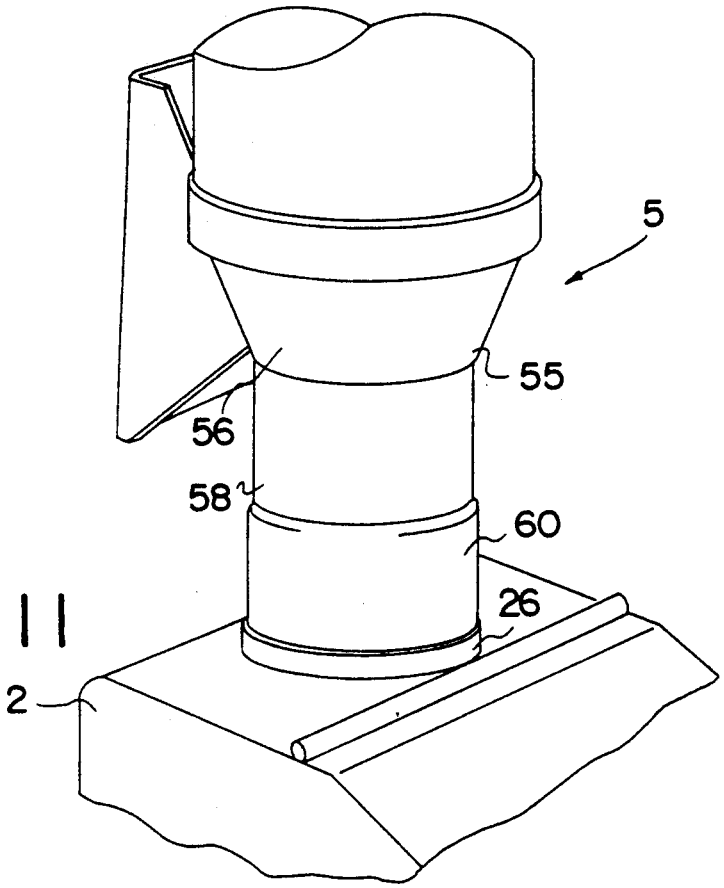
FIG. 11 is a perspective view of an alternative funnel assembly for the device of the present invention.
Figure 12:
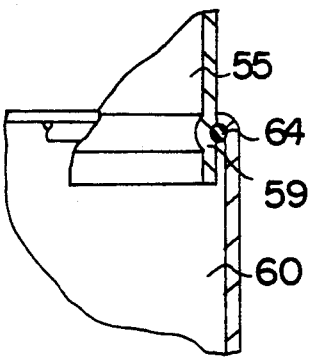
FIG. 12 is a cross-sectional portion illustrating the connection of the parts of the funnel assembly of FIG. 11.

The most preferred embodiment of the funnel assembly 5 is shown in FIGS. 11 and 12. In this embodiment, the funnel assembly 5 has the basic funnel 55, an extension piece 60 and an internal o-ring 64 which connects together the funnel and the extension piece. The basic funnel 55 includes an inverted cone shaped portion 56 and a cylindrical portion 58. The extension piece 60 has an internal diameter so as to sliding fit over the outside of cylindrical portion 58. As shown clearly in FIG. 12, cylindrical portion 58 has a groove 59 which is adapted to receive o-ring 64. O-ring 64 and the internal diameter of extension piece 60 are sized such that when the o-ring is in groove 59, the ring contacts the internal surface of the extension piece to connect the extension piece to the funnel assembly.

The extension piece 60 is also made of aluminum. The o-ring 64 is a conventional ring made, preferably, of rubber, but could be made of plastic, metal and the like.

The position of the extension tube will vary depending upon the nature or consistency of the confectionery or food product to be dispensed. While not needed, it is possible to have a ring 26 which acts to seal the diameter spacing between the narrow end of funnel assembly 5, whether it be the funnel 55 or the extension piece 60, and the opening 19.

The funnel assembly 5 connects the vertical display and storage tube 6 to the product bin 2. As is best illustrated in FIG. 1, the funnel or funnel assembly 5 and display and storage tube 6 may also be adapted to connect to wall brackets 27 which, in turn, may be secured to a wall panel by means of screws (not shown) or other fastening means. The wall brackets 27 provide added vertical support and fixes positioning to the tube 6 and the funnel assembly 5.

The funnel assembly and the regulator panel 18 work in concert to regulate the speed of the bulk food entering into bin 2. Further, the extension piece 60 of the funnel assembly 5 permits the funnel assembly to be readily positioned into the opening 19 of the top wall 11 of the bin 2. Moreover, once the bin 2 is positioned in place on the wall mount unit 25, the extension piece 60 provides the flexibility to permit the tube 6 and the bin to be connected together.

It should be understood that FIGS. 11 and 12 illustrate the preferred funnel assembly 5 and, in particular, the preferred extension piece 60 and means of connection of the extension piece to the basic funnel 55. However, the extension piece 60 could be a flexible section of tubing adapted to connect or integrally connected to the funnel 55. The reason that the illustrated funnel assembly 5 is preferred is because the extension piece slides up to permit disassembly or cleaning of the bin 2 without disassembly of the funnel and assures that food particles will not get lodged in the extension piece 60 or the connection of the extension piece to the funnel 55 and the bin 2.

Referring to FIG. 7, the raking means 16 has a rod 28 with hollow ends each designed to accommodate a screw. In the preferred embodiment, a ball-shaped handle 29 is attached to one end and scoop means, such as a rake 30, is attached to the opposite end of the raking means 16 by screws 31. This design allows the merchant to assemble the raking means 16 by attaching the scoop means 30 to the rod 28 passing the rod up through the interior of the empty product bin 2 and out through aperture 15 for attachment of a handle, such as the ball-shaped handle 29. This design further permits the raking means 16 to be taken apart for cleaning purposes. A different scoop means 30, such as a cup, may also be employed, although the rake is preferred. Both the ball-shaped handle 29 and scoop means 30 are larger than the aperture 15, thereby preventing the assembled raking means 16 from being easily removed from the device 1, short of unscrewing the scoop means 30 from the inside of the product bin 2. It is also preferable to manufacture the rod 28 from a hard, but pliable resilient plastic material, such as lexan. The thickness of the rod 28 may vary, but the use of a material such as lexan is preferable because such material prevents the rod from being snapped and/or broken during normal operation of the device 1. The ball-shaped handle 29 provides an additional safety feature since it protects the customer from being injured by the sharp edges of the raking means 16.

The dispensing unit 4 can best be viewed in FIGS. 2, 3 and 6. The dispensing unit 4 includes a four-sided module 35 and a door 36. In the preferred embodiment, the module 35 and door 36 are also molded from a clear, top-quality acrylic plastic material such as plexiglass, both to maintain maximum product visibility and to ensure durability. It is also possible to mold the module 35 from one piece of plastic material into a uniform rectangular unit. In the preferred embodiment, each rectangular wall of the module 35 is approximately 2½ inches long and 3¾ inches wide to permit the dispensing unit 4 to be inserted into an opening located in and bonded to the front wall 12 of the product bin 2. Approximately ¼" from the lower corners of the side walls of the module 35 are two holes 37, each approximately ¼" in diameter designed to accommodate pivot pins 39. Preferably, these holes 37 are located ½" from the lower corners of the side walls of the module to allow for unhampered operation of the dispensing unit door 36, although the holes may be placed between ¼" inch and 1 inch from the corners.

The door 36 of the dispensing unit 4 is preferably molded from a single piece of a clear, top-quality acrylic plastic material such as plexiglass to form a base with two parallel side pieces, each also containing a circular hole 38 designed to accommodate the pivot pins 39. The door 36 is further contoured to form a spout when engaged, which thereby permits easy dispensing of the desired quantity of food product from the dispensing module into a bag or other means for purchasing. The door 36 is fastened to module 35 by aligning holes the circular 38 in the side pieces of the door 36 with their counterpart holes 37 in the side walls of the module. When pivot pins 39 are inserted, the door 36 is secured onto the module 35. The pivot pins 39 also form a hinge which permits manipulation of the door 36 in a downward plane. At the rear of the door 36, a metallic weight 40 is fixed by bonding or other means. The weight acts to maintain the door 36 fixed in a closed position at the mouth of the dispensing unit 4.

Figure 8:
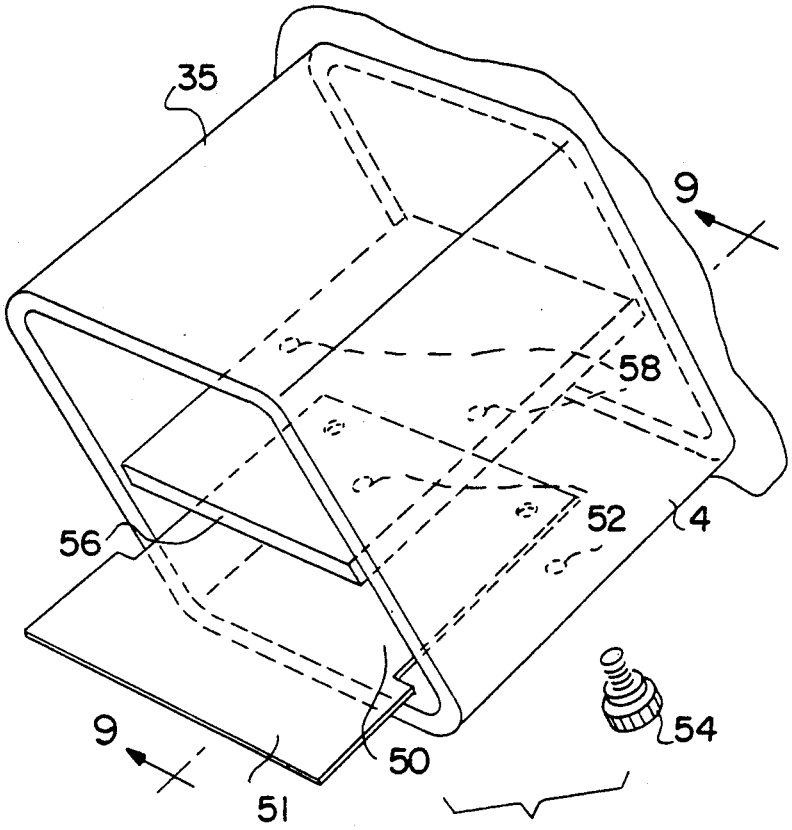
FIG. 8 is an exploded perspective view of an alternative embodiment a of portion of the dispensing unit of the device of FIG. 1.
Figure 9:
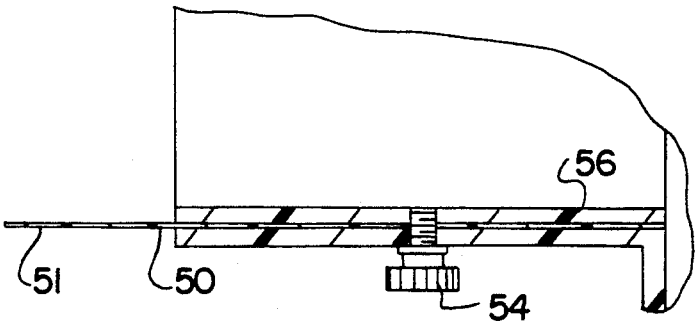
FIG. 9 is a cross-sectional view of the dispensing unit of FIG. 8.

In the preferred embodiment of the dispensing unit 4 shown in FIGS. 8 and 9, the dispensing unit is provided with an additional feature to ensure smooth operation, and allow the unit to be easily cleaned. In the preferred embodiment, a thin strip of clear, flexible plastic material 50 is affixed to the interior of the module 35 so that the material and hinged door forms a seal when the door is in the closed position. A principal advantage of this seal is to maintain smooth operation of the door while simultaneously minimizing loss or damage to the dispensed product, and to provide for quick and easy cleaning of the dispensing unit module 35.

Specifically, in this embodiment, two additional holes 52 of sufficient width to accommodate small screws 54 (only one is shown) may be drilled in the bottom surface of the dispensing unit 4 at the midway point approximately halfway down the length of the surface. The strip 50 of a clear plastic material, such as mylar, approximately 4 inches in length and equal in width to the bottom surface of the module 35, and contoured to form a lip 51 approximately 1¼ inch extending from the mouth of the module, is placed upon the bottom surface of the module and secured thereto by means of a rectangular plexiglass plate 56.

The plate 56 should be of dimensions slightly less than the surface of the unit 4, and is also provided with two holes 58 located approximately at a midway point on the surface. When the holes 58 in the plate 56 and the holes 52 in the module 35 are aligned, the plate may be secured by means of two screws 54, which in turn hold the mylar strip in place. The extended lip 51 of the mylar strip rests against the surface of the door 36, and acts to add integrity to the actions of the dispensing unit 4, by ensuring free and continuous flow of the dispensed product during operation of the door. Further, it acts to form a seal along the surface of the module 35 during dispensing of the bulk food products, and prevents food particulate residue from becoming trapped in the hinge area formed by the door 36 and the module in the dispensing unit 4. Similarly, it acts to prevent damage to the bulk foods purchased by preventing them from becoming trapped at the hinge.

It should be appreciated that the present device 1 is constructed to provide certain advantages or features that optimize performance. For example, the aperture 15 and raking means 16 are located in the front wall 12 of the product bin 2 to allow for continual, smooth raking movements, thereby minimizing the possibility of damage to the confectionery or other food product. The location of the raking means 16 has been designed to prevent it from interfering the customer's view of the dispensed food product, thereby providing a further means for maximum customer control. The aperture 15 has been designed to have smooth edges, thereby ensuring a smooth raking motion and minimizing the opportunity for damage to the raking means 16.

The raking means 16, which preferably is made of a pliable but durable plastic material, such as lexan, provides an increased measure of safety, since the material will prevent the user from breaking the raking means during ordinary operation. The ball-shaped handle 29, as mentioned above, eliminates any danger posed by the exposed handle of the raking means 16.

The dispensing unit 4 into which the customer may direct the specific quantity of bulk food product intended for purchase allows the customer maximum control over the amount of product to be purchased. This acts to minimize losses while simultaneously protecting the remaining food product from contamination of the product bin 2 by the commingling of dispensed material. The food product may be ultimately dispensed from the unit through the operation of a hinged door, which, when engaged, forms a dispensing spout.

Having thus described the invention with particular reference to the preferred forms thereof, it will be obvious that various changes and modifications may be made therein without departing from the spirit and scope of the invention as defined by the appended claims.

Wherefore, we (I) claim:

1. A dispenser for dispensing particulate goods, comprising:

means for receiving and storing the particulate goods, said receiving and storing means having a top wall with an opening for receiving bulk goods and having slot means therethrough, a front wall, a bottom wall connected to said front wall, and a removable bottom plate;

a dispensing unit positioned in said front wall, and having a housing and a movable door adapted to be attached to said housing, said door forming a spout for dispensing the particulate goods when said door is positioned in a downward plane;

means adapted to be secured into position through said front wall, for manipulating the particulate goods from said receiving and storing means into said dispensing unit; and regulator means, positioned in said slot means, said regulator means adapted to be moved in said slot means to regulate the amount of the particulate goods into and through separate portions of said receiving and storing means.

2. The dispenser according to claim 1, wherein said bottom plate is positioned on said bottom wall in said receiving and storing means.

3. The dispenser according to claim 1, wherein said receiving and storing means has a space formed between said bottom wall and said front wall to permit entry of a removable bottom plate.

4. A dispenser for dispensing particulate goods, comprising:

means for receiving and storing the particulate goods, said receiving and storing means having a top wall with an opening for receiving bulk goods, a front wall, and a bottom wall, said top wall having a slot means therethrough, wherein said receiving and storing means has a space formed between said bottom wall and said front wall to permit entry of a bottom plate, and wherein said bottom plate is adapted to rotate into an operative position in said receiving and storing means and can be removed from said receiving and storing means upon rotation from said operative position;

a dispensing unit positioned in said front wall, and having a housing and a movable door adapted to be attached to said housing, said door forming a spout for dispensing the particulate goods when said door is positioned in a downward plane;

means adapted to be secured into position through said front wall, for manipulating the particulate goods from said receiving and storing means into said dispensing unit; and regulator means, positioned in said slot means, to regulate the amount of the particulate goods into and through portions of said receiving and storing means.

5. A dispenser for dispensing particulate goods, comprising:

means for receiving and storing the particulate goods, said receiving and storing means having a top wall with an opening for receiving bulk goods, a front wall, and a bottom wall, said top wall having a slot means therethrough, wherein said receiving and storing means has a space formed between said bottom wall and said front wall to permit entry of a bottom plate, and wherein said bottom plate has a strip that closes the space;

a dispensing unit positioned in said front wall, and having a housing and a movable door adapted to be attached to said housing, said door forming a spout for dispensing the particulate goods when said door is positioned in a downward plane;

means adapted to be secured into position through said front wall, for manipulating the particulate goods from said receiving and storing means into said dispensing unit; and regulator means, positioned in said slot means, to regulate the amount of the particulate goods into and through portions of said receiving and storing means.

6. The dispenser according to claim 1, further comprising a storage and display tube and a funnel assembly connected to said storage and display tube.

7. The dispenser according to claim 6, wherein said funnel assembly is a funnel.

8. The dispenser according to claim 6, wherein said funnel assembly includes a funnel, an extension piece and means for connecting together said funnel and said extension piece.

9. The dispenser according to claim 6, further comprising a ring to connect said funnel assembly to said top wall.

10. The dispenser according to claim 6, wherein said funnel assembly connects said storage and display tube to said opening in said top wall, and has a portion thereof with a diameter which gradually decreases from said storage and display tube to said opening thereby controlling, in conjunction with said regulator means, the speed of the particulate goods moving into said receiving and storing means.

11. The dispenser according to claim 1, wherein said dispensing unit has a bottom surface and includes a strip of a transparent pliable plastic material adapted to extend along the bottom surface.

12. The dispenser according to claim 1, wherein said receiving and storing means includes side walls which are provided with slots to accommodate a structure for horizontally mounting a plurality of said dispensers.

13. The dispenser according to claim 1, wherein said receiving and storing means is made of acrylic plastic.

14. The dispenser according to claim 1, wherein said dispensing unit is made of acrylic plastic.

15. A dispenser for dispensing particulate goods, comprising:

means for receiving and storing the particulate goods, said receiving and storing means having a top wall with an opening for receiving bulk goods, a front wall, and a bottom wall, said top wall having slot means therethrough;

a dispensing unit positioned in said front wall, and having a housing and a movable door adapted to be attached to said housing, said dispensing unit having a bottom surface, said door forming a spout for dispensing the particulate goods when said door is positioned in a downward plane;

means adapted to be secured into position through said front wall, for manipulating the particulate goods from said receiving and storing means into said dispensing unit;

regulator means, positioned in said slot means, to regulate the amount of the particulate goods into and through portions of said receiving and storing means;

a strip of a transparent pliable plastic material adapted to extend along the bottom surface of said dispensing unit; and a plate for securing said plastic material between said plate and the bottom surface of said dispensing unit.

16. The dispenser according to claim 6, wherein said funnel assembly is made of metal.

17. A dispenser for dispensing particulate goods, comprising:

means for receiving and storing the particulate goods, said receiving and storing means having a top wall with an opening for receiving bulk particulate goods, a front wall, and a bottom wall which angles downward towards said front wall, said top wall having slot means therethrough;

a dispensing unit positioned in said front wall, and having a housing and a movable door adapted to be attached to said housing, said door forming a spout for dispensing the particulate goods when said door is positioned in a downward plane;

a funnel assembly adapted to be connected to said receiving and storing means, wherein said funnel assembly includes a funnel, an extension piece and means for connecting together said funnel and said extension piece;

a ring to connect said funnel assembly to said top wall;

a storage and display tube adapted to be connected to said funnel assembly, wherein said funnel assembly meters the particulate goods entering from said storage and display tube into said receiving and storing means;

means adapted to be secured into position through said front wall, for manipulating the particulate goods from said receiving and storing means into said dispensing unit; and regulator means, positioned in said slot means, said regulator means adapted to be moved to regulate the amount of the particulate goods into and through separate portions of said receiving and storing means.

* * * * *